United States Patent [19]

Lesquereux et al.

[11] 4,442,341

[45] Apr. 10, 1984

[54] ELECTRIC ANTIFREEZE HEATING DEVICE FOR LOCK CYLINDERS AND MOUNTING ARRANGEMENT THEREFOR

[76] Inventors: Yvan Lesquereux; Pierre-Andre Lesquereux, both of 2, rte. de Duillier, Nyon, CH - 1260, Switzerland

[21] Appl. No.: 398,754

[22] Filed: Jul. 15, 1982

[30] Foreign Application Priority Data

Jul. 20, 1981 [CH] Switzerland ..... 4728/81

[51] Int. Cl.[3] ..... E05B 17/00; H05B 3/02

[52] U.S. Cl. ..... 219/201; 70/431; 219/202; 219/505; 219/535; 219/536

[58] Field of Search ..... 219/200, 201, 202, 535, 219/526, 536, 542, 505; 70/431

[56] References Cited

U.S. PATENT DOCUMENTS

| | | | |
|---|---|---|---|
| 1,423,742 | 7/1922 | Silverman | 219/535 |
| 3,662,149 | 5/1972 | Lipinski | 219/201 |
| 4,110,603 | 8/1978 | Peterson et al. | 219/535 |

FOREIGN PATENT DOCUMENTS

| | | | |
|---|---|---|---|
| 2758849 | 7/1979 | Fed. Rep. of Germany | 219/202 |
| 524043 | 7/1972 | Switzerland | 219/201 |

*Primary Examiner*—A. Bartis

*Attorney, Agent, or Firm*—Saul Jecies

[57] ABSTRACT

An antifreeze electric heating device for vehicle and housedoor lock cylinders includes an electrically non-conducting pressure body having two transverse wing pairs forming guide grooves for an elastic tension member e.g., rubber band, detachably secured to the pressure body and adapted to surround a lock cylinder for biasing a bearing side of the pressure body into heat exchange relationship with the lock cylinder. The pressure body includes a recess in which is lodged a PTC electric resistance heating element embedded in a heat-conductive, electrically insulative silicone-based compound. A U-shaped sheet metal strip electrically connected to one contact of the PTC heating element closes the recess and is arranged to contact the lock cylinder so that the electric circuit for the PTC heating element is completed by engagement of the metal strip with the lock cylinder under the biasing influence of the tension member. The other contact of the PTC heating element is provided with a terminal plug for connection to a power supply.

4 Claims, 4 Drawing Figures

Fig. 1
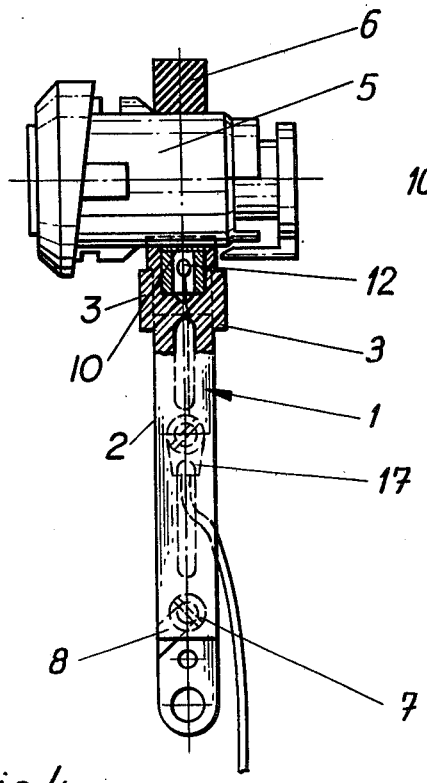
Fig. 2
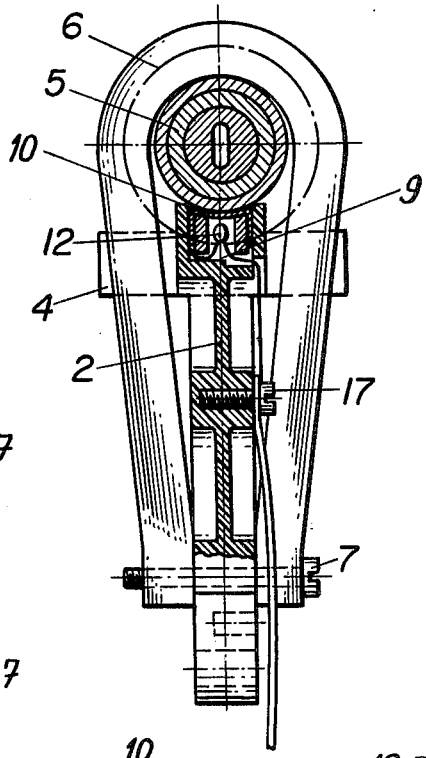
Fig. 4
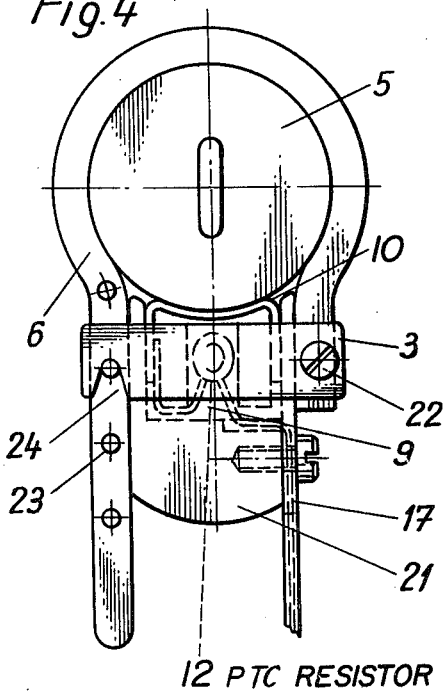
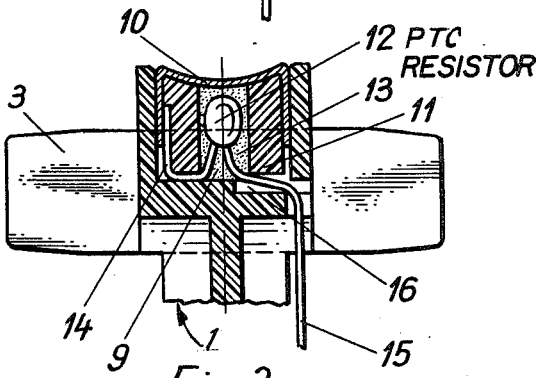
Fig. 3

ELECTRIC ANTIFREEZE HEATING DEVICE FOR LOCK CYLINDERS AND MOUNTING ARRANGEMENT THEREFOR

The invention concerns an antifreeze device for lock cylinders, specifically for vehicle and house-door locks, with at least one PTC resistor.

Iced locks, especially on vehicles, frequently cause unpleasant and time-consuming trouble, particularly when the person involved is in a hurry. Solutions were therefore proposed in view of counteracting such trouble.

The same inventors have had a device patented where pushing in the key actuates a switch that switches on a heating current.

In Swiss Pat. No. 524,043 was proposed a device with a metal tension ring for clamping around the lock cylinder. Two PTC resistors are fixed to the tension ring.

The purpose of the invention is to provide a device that prevents in advance any precipitation and icing, particularly of the bottom part of the lock cylinder and that allows for simple, easy and reliable assembling without special tools.

This purpose is achieved through the invention by a device that is characterized in that it is provided with one non-conducting pressure body with two transverse wing pairs forming two guide grooves as well as with an elastic tension means surrounding the lock cylinder and hooked in a detachable manner into the pressure body with the PTC resistor against the lock cylinder, that the bearing side of the pressure body is provided with a recess sealed by a U-shape bent sheet metal strip that comes to rest against the lock cylinder, in which recess is lodged the PTC resistor, and that on the ressure body is provided a terminal plug connected with one of the conductors of the PTC resistor and that the other conductor of the PTC resistor is in contact with the sheet metal strip.

The drawing shows two exemplary versions of the object of the invention. They show in:

FIG. 1—the longitudinal view of a lock cylinder with installed heating device, partly as a sectional view;

FIG. 2—a sectional view in accordance with FIG. 1;

FIG. 3—the assembly of the thermally controlled resistor in accordance with FIG. 2—scale 2:1; and FIG. 4—a second version of these heating device assembled to the lock cylinder, seen from the front side.

The device represented (FIGS. 1, 2 and 3) has a non-conducting, cross-like pressure body 1 (FIG. 2). This body is designed with one longitudinal bar 2 and with two wing pairs 2 arranged laterally of the longitudinal bar 2 (FIG. 1). The projecting arts of the wing pairs 3 form on both sides of the longitudinal bar 2 one guide groove 4 each. A rubber band 6 pulled around the lock cylinder 5 as a tension means is prevented from shifting in the guide grooves 4. Both ends of the rubber band 6 are so connected with a screw 7 that a gap equal to the tickness of the longitudinal bar 2 remains. The rubber band 6 is stretched and hooked with the middle section of screw 7, in a detachable manner, into a sot 8 in the longitudinal bar 2 (FIGS. 1 and 2), so that it pulls the pressure body 1 at one longitudinal end of the longitudinal bar 2 against the lock cylinder 5.

The bearing side of this longitudinal end has a recess 9. The latter is sealed by a sheet metal strip 10 that comes to rest against the lock cylinder 5 (FIGS. 2 and 3). Into this recess 9 has been fitted a bored-through, electrically non-conducting plug 11 by which the sheet metal strip 10 is clamped fast at the side. This plug bore serves to accept a PTC resistor 12 embedded in a heat-conducting, electrically non-conducting silicone-based compound 13. The one connecting conductor 14 of the PTC resistor 12 is bent and placed between the plug 11 and the sheet metal strip 10, with which it is in contact. The other connecting conductor 15 of the PTC resistor 12 leads through an opening 16 (FIG. 3) to a terminal plug 17 (FIGS. 1 and 2) placed in the middle section of longitudinal bar 2. A power source is connected permanently through terminal 17 and with the mass of lock cylinder 5. With outside temperatures above zero degree Centigrade, power consumption of the PCT resistor 12 is very low because of the steeply rising positive temperature coefficient of resistance and it is about 14 to 20 milliamp/h for a temperature of minus 20 degree Centigrade.

The device can be easily and reliably mounted by do-it-yourself assembly.

As FIG. 4 shows, the device can be designed in a compact form, without longitudinal bar 2. Pressure body 21 is unchanged on its pressure side as compared to FIG. 3. Wing pairs 3 will be a little closer to the pressure side. Rubber band 6 is secured by a screw 22 to one of the projecting wing pairs 3, stretched around lock cylinder 5 and hooked by means of a cross pin 23 into a notch 24 of the other wing pair 3. The terminal plug 17 is fitted close to recess 9 and to the extreme end of pressure body 21. The length of pressure body 21 is therefore less than the span of the transverse wing pairs 3.

If the casing of the lock cylinder 5 has lock parts that can be moved longitudinally, then these will be bridged in such a manner that rubber band 6 is stretched over them without shifting.

We claim:

1. An antifreeze device for locking cylinders for vehicle and house door locks comprising at least one PTC resistor, a non-conducting pressure body, said pressure body including two transverse wing pairs, said wing pairs forming two guide grooves, an elastic tension means, said elastic tension means adapted to surround a lock cylinder and be hooked in a detachable manner to the pressure body and engaged in said guide grooves, said tension means adapted to push a bearing side of the pressure body, in heat exchange relationship with said at least one PTC resistor within said body, against the lock cylinder, the bearing side of the pressure body being defined by a recess sealed by a U-shaped bent sheet metal strip that comes to rest against the lock cylinder, said recess lodging said at least one PTC resistor, said pressure body including a terminal plug connected with one of the conductors of said at least one PTC resistor and the other conductor of said at least one PTC resistor being in contact with the sheet metal strip, so that the circuit to said at least one PTC resistor is completed by engagement of said metal strip with the lock cylinder.

2. A device according to claim 1, wherein one electrically non-coducting drilled-through plug is fitted into said recess, said at least one PTC resistor being embedded in the bore of said recess in a heat-conducting electrically non-conducting compound.

3. A device according to claim 2, wherein the pressure body includes a longitudinal bar and that the elastic tension means is a rubber band, both ends of which are connected at a distance from the cylinder lock with a screw, with this screw hooked in a detachable manner in a slot at the longitudinal bar.

4. A device according to claim 2, wherein the length of the pressure body, as measured in the pressure direction, is less than the span of the transverse wing pairs and that the elastic tension means is a rubber band, one end of which is secured by a screw between one wing pair and the other end of which has cross pins and is hooked by one of these in a detachable manner in a notch of the other wing pair.

* * * * *